US006237840B1

(12) United States Patent
Grabowski et al.

(10) Patent No.: US 6,237,840 B1
(45) Date of Patent: May 29, 2001

(54) CONTAINER WITH IMPROVED HAND HOLE

(75) Inventors: Joseph W. Grabowski, Sidney, NE (US); Timothy N. Berelsman, Delphos, OH (US); Wesley D. Wiegand, Sidney, NE (US)

(73) Assignee: Prestolite Corporation, Southfield, MI (US)

( * ) Notice: Subject to any disclaimer, the term of this patent is extended or adjusted under 35 U.S.C. 154(b) by 0 days.

(21) Appl. No.: 09/368,615

(22) Filed: Aug. 4, 1999

(51) Int. Cl.[7] ..... B65D 5/46

(52) U.S. Cl. ..... 229/117.16; 229/155; 229/158; 229/150

(58) Field of Search ..... 229/155, 156, 229/157, 158, 126, 142, 148, 150, 117.13, 117.16, 117.15, 120, 24.2

(56) References Cited

U.S. PATENT DOCUMENTS

| | | | | |
|---|---|---|---|---|
| D. 329,199 | | 9/1992 | Corso . | |
| D. 350,480 | | 9/1994 | Suitherland . | |
| D. 364,087 | | 11/1995 | Farley . | |
| 1,965,503 | * | 7/1934 | Lowman | 229/150 |
| 2,090,882 | * | 8/1937 | Zimmerman | 229/150 |
| 2,269,013 | * | 1/1942 | Dorfman | 229/117.15 |
| 2,315,094 | * | 3/1943 | Rehfield et al. | 229/126 |
| 2,731,191 | | 1/1956 | Layne . | |
| 3,113,702 | | 12/1963 | Luedtke . | |
| 3,150,769 | | 9/1964 | Cohn . | |
| 3,522,904 | * | 8/1970 | Locke et al. | 229/126 X |
| 3,899,121 | * | 8/1975 | Herbetko | 229/120 |
| 4,083,487 | * | 4/1978 | Zattoni | 229/150 X |
| 4,165,031 | | 8/1979 | Osborne . | |
| 4,313,547 | | 2/1982 | Osborne . | |
| 4,509,640 | | 4/1985 | Joyce . | |
| 4,702,408 | * | 10/1987 | Powlendo | 229/101 |
| 5,018,663 | * | 5/1991 | Corso | 229/117.13 |
| 5,356,022 | * | 10/1994 | Tipps | 229/242 X |
| 5,392,984 | | 2/1995 | Yocum . | |
| 5,400,955 | | 3/1995 | Coalier et al. . | |
| 5,584,430 | | 12/1996 | Mulry . | |
| 5,769,028 | * | 1/1999 | Deckys | 229/117.15 |
| 5,860,555 | * | 1/1999 | Mayled | 229/907 X |

* cited by examiner

*Primary Examiner*—Allan N. Shoap
*Assistant Examiner*—Tri M. Mai
(74) *Attorney, Agent, or Firm*—Rader, Fishman & Grauer PLLC

(57) ABSTRACT

A fiberboard blank for making a container is disclosed. The blank has a first, a second, a third and a fourth side panel. A first, a second, and a third upper flap are foldably connected to the first, second, and third side panels respectively. The first and third side panels have a first and third hand hole and a first and second slot, respectively. The second upper flap has a second hand hole and a first projection. Upon assembly of the container, the first, second, and third hand holes align, the first and second slots align and the first projection is received in the first and second slots.

13 Claims, 4 Drawing Sheets

CONTAINER WITH IMPROVED HAND HOLE

FIELD OF INVENTION

The present invention relates to fiberboard containers, and more particularly to fiberboard containers having hand holes extending through their tops.

BACKGROUND OF THE INVENTION

Fiberboard containers are used with a wide variety of articles. With many articles, it is extremely convenient to have one or more handles on the top of a container. When a handle is located on the container top, a person may carry the container, and articles in the container, with one hand while maintaining the other hand free. However, one handle on the top of a container is often required to support heavy articles that traditionally may have been supported by a box having two handles. As a result, the top handle of a fiberboard container may break, thereby inconveniencing a person carrying the container, and if the container is actually dropped, articles inside the container may be damaged.

Attempts to solve the problem of handle breakage have taken different forms. For example, fiberboard containers have been manufactured having handles made from alternative materials other than fiberboard. Also, alternative materials and extra fiberboard have been used to reinforce the handles. Although these attempts have met with reasonable success, they typically increase the complexity of container manufacture, and require more and different material.

SUMMARY OF INVENTION

The invention is directed to a fiberboard blank for making a container which may be constructed from corrugated cardboard. The blank includes a first side panel foldably connected to a first upper flap, a second side panel foldably connected to a second upper flap, a third side panel foldably connected to a third upper flap and a fourth side panel. The first upper flap has a first slot and a first hand hole. The second upper flap has a second hand hole and a first projection. The third upper flap has a second slot and a third hand hole. The first, second, third and fourth panels are foldably connected to each other in an order that allows adjacent panels to be folded at substantially right angles to one another such that the first and third panels oppose each other and the second and fourth panels oppose each other. The first and third upper flaps may be folded to overlap each other and align the first hand hole with the third hand hole and the first slot with the second slot. The second upper flap may be folded over such that the second hand hole aligns with the first and third hand holes and the first projection is received in the first and second slots.

DESCRIPTION OF PREFERRED EMBODIMENTS

Figure 1:
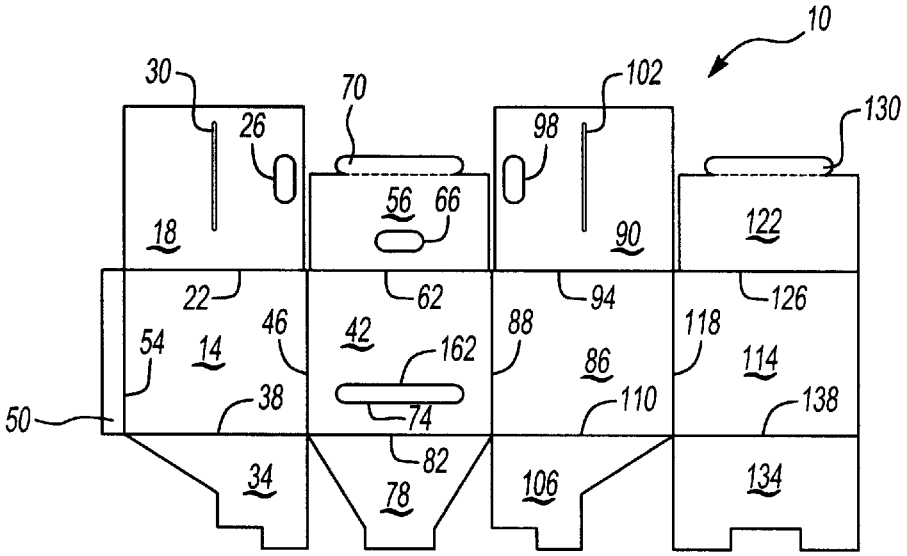
FIG. 1 is a top view of a fiberboard blank according to the one embodiment of the present invention.

A fiberboard blank 10 according to an embodiment of the present invention is illustrated in FIG. 1. The blank 10 includes a first side panel 14 foldably connected to a first upper flap 18 along a fold line 22. The first upper flap 18 includes a first hand hole 26 and a first slot 30. Also, the first side panel 14 is foldably connected to a first lower flap 34 along a fold line 38, a second side panel 42 along a fold line 46 and an attachment flap S0 along a fold line 54.

The second side panel 42 is foldably connected to a second upper flap 58 along a fold line 62. A second hand hole 66 extends through the second upper flap 58 and a first projection 70 is attached to the second upper flap 58. Furthermore, the second side panel is foldably connected to a second lower flap 78 along a fold line 82 and to a third side panel 86 along another fold line 88.

The third side panel 86 is foldably connected to a third upper flap 90 along a fold line 94. A third hand hole 98 and a second slot 102 extend through the third upper flap 90. Moreover, the third side panel 86 is foldably connected to a third lower flap 106 along a fold line 110 and to a fourth side panel 114 along another fold line 118.

The fourth side panel 114 is foldably connected to a fourth upper flap 122 along a fold line 126 and the fourth upper flap 122 has a second projection 130. The fourth side panel 114 is also foldably connected to a fourth lower flap 134 along a fold line 138.

Manufacture amd Assembly of Container

Figure 5:
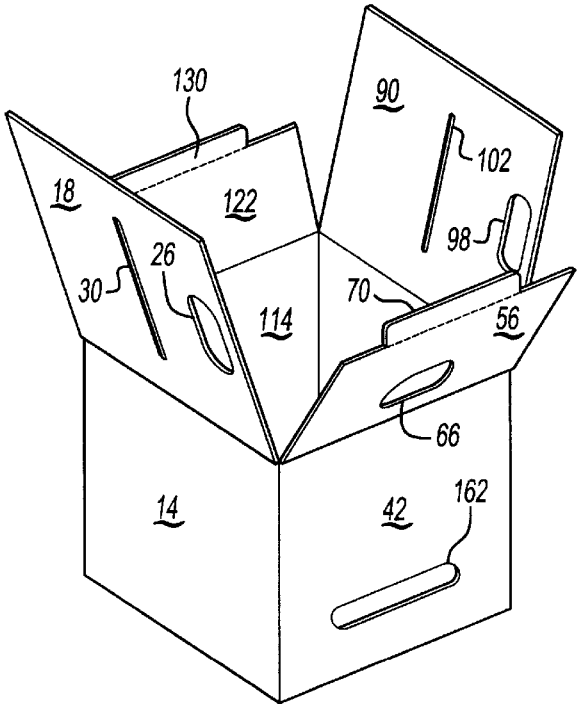
FIGS. 5–7 are perspective views of different stages of assembly of the container using the fiberboard blank of FIG. 1.

To create a container from the fiberboard blank 10 of FIG. 1, the first side panel 14 is folded along the fold line 46 between the first and second panels 14, 42 to make substantially a right angle between the first and second panels 14, 42. The third side panel 86 is folded along the fold line 90 between the second and third panels 42, 86 to make a substantially right angle between the second and third panels 42, 86 and so that the first and third panels 14, 86 substantially oppose each other. The fourth panel 114 is folded along the fold line 118 between the third and fourth panels 86, 114 to make a substantially right angle between the third and fourth panels 86, 114 and so that the second and fourth panels 42, 114 substantially oppose each other, as shown in FIG. 5.

The first and fourth panels 14, 114 should be adjacent or nearly adjacent at this point such that the attachment flap 50 may be attached to the fourth side panel 114. The attachment may be accomplished, for example with glue, staples, interconnecting fiberboard pieces or other methods known in the art. In another embodiment of the invention, the attachment flap 50 could be foldably connected to the fourth side panel 114 instead of the first side panel 14, and the attachment flap 50 would have to be glued, stapled, interconnected or the like to the first side panel 14. In still another embodiment of the invention, the attachment flap 50 may be completely removed and other methods may be used to attach the first and fourth side panels 14, 114 to each other. A person of skill in the art will be able to imagine many ways of connecting the first and fourth panels 14, 114 as desired. Attachment of the first and fourth panels 14, 114 adds structural integrity to the container once it is fully assembled, but it is not necessary for the present invention. In still another embodiment of the invention, the blank 10 may be manufactured such that the first and fourth side panels 14, 114 are already foldably connected along a fold line (not shown). In this particular embodiment, the first, second, third and fourth side panels 14, 42, 86, 114 form an unbroken chain of panels and therefore attachment flap 50 is unnecessary because the first and fourth side panels 14, 114 are already connected.

Figure 6:
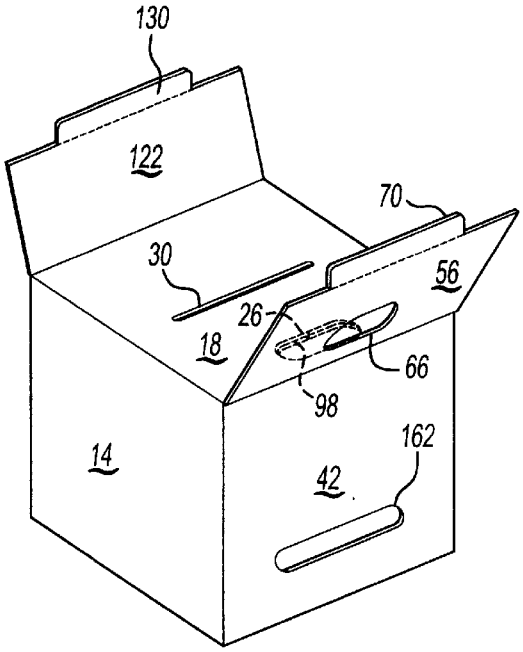

Since the first and third panels 14, 86 oppose each other, the first and third upper flaps 18, 90 may be folded over at substantially right angles along the fold lines 22, 94 such that the first and third upper flaps 18, 90 overlap each other. In this configuration, the first and third hand holes 26, 98 align and the first and second slots 30, 102 align, as shown in FIG. 6. Either the first or the third upper flap 18, 90 may be folded over first, followed by whichever is remaining. The first and the third flaps 18, 90, once folded, may be sealed or attached to each other, for example, with staples or glue.

Figure 7:
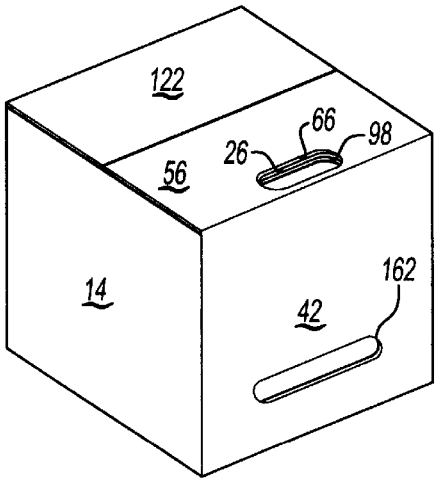

The second and fourth upper flaps 58, 122 also oppose each other, and may be folded at substantially right angles along the fold lines 62, 126 such that the second and fourth upper flaps 58, 122 overlap the first and third upper flaps 18, 90 and the second hand hole 66 aligns with the first and third hand holes 18, 90. The first and second projections 70, 130 become closely associated with each other above the first and seconds slots 30, 102 when the second and fourth upper flaps 58, 122 are folded over such that the first and second projections 70, 130 may be forced into an interference fit with the first and seconds slots 30, 102, as shown in FIG. 7. It is convenient to have the first, second and third hand holes 26, 66, 98 align near a side panel of the container such that a person carrying the container may press their thumb against the side panel of the container and place their other fingers in the aligned first second and third hand holes 26, 66, 98. Thus, first, second, and third hand holes 26, 66, 98 preferably are not located in the center of a respective flap, but rather are placed adjacent an edge of that flap.

The first and second projections 70, 130 may be foldably connected to the second and fourth upper flaps 56, 122 respectively to allow the first and second projections 70, 130 to be easily angled into the first and second slots 30, 102. The first and second projections 70, 130 may be in an elongated D-shape as shown in FIG. 1, or they could take any shape that results in an interference fit with the first and second slots 30, 102. The first and second projections 70, 130 may also be attached to each other with, for example, glue or staples, or any other fastening means known in the art. Further, the first and second projections 70, 130 are only one method of attaching the second and fourth upper flaps 58, 122 to the first or third upper flaps 18, 90. However, first and second projections 70, 130 may be omitted if alternative attachment means are used.

In another embodiment of the invention, the fourth upper flap 122 may be entirely removed. The fourth upper flap 122 assists in maintaining the fourth side panel 114 in close proximity to the first side panel 14 and may add structural integrity to the container. However, if the attachment flap 50 or some other attachment or connection method is used to secure the first side panel 14 to the fourth side panel 114, the fourth upper flap 122 may not be needed.

The bottom of the container in FIG. 1 includes first, second, third and fourth lower flaps 34, 78, 106, 134 that may be folded at substantially right angles to the first, second, third and fourth side panels 14, 42, 86, 114 and interconnected to each other into a crash-bottom style. The crash-bottom style is only one of many possibilities for the bottom of the container. The bottom of the container may include two to four substantially square or rectangular lower flaps foldably connected to the side panels. In that case, the lower flaps may be folded to overlap each other and then glued or stapled together. The bottom may be a square or rectangular piece of material stapled or glued to the first, second, third and fourth panels 14, 42, 86, 114. The person of ordinary skill in the art will be able to imagine many different possibilities for the bottom of the container. The choice of bottom for the container will depend on the articles that are to be placed in the container. For example, heavy articles that reside on the bottom of the container may need the four substantially square rectangular flaps stapled together to support the heavy articles. On the other hand, no bottom at all or the crash-bottom style will be sufficient for articles like spooled wire that may be attached to a rod that is supported by the side panels of the container.

The fiberboard blank 10 and any fiberboard blanks hereinafter mentioned may be cut and scored with conventional fiberboard stock using conventional die cutting apparatuses. The thickness of the stock and the material used as stock will depend upon the weight of the articles to be carried in the container. Typically, the stock will be corrugated cardboard, but it may also be any material known in the art that is used to make containers where the material may be folded as previously described

Alternative Embodiments

Figure 2:
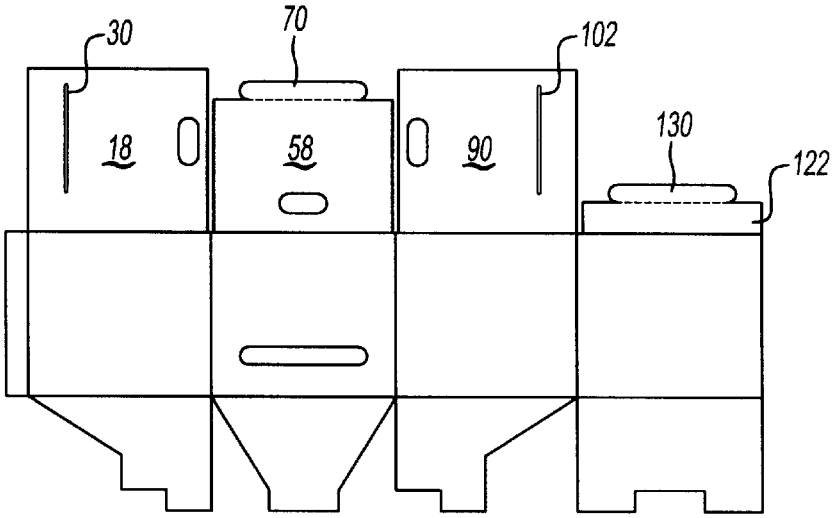
FIG. 2 is a top view of a fiberboard blank according to another embodiment of the present invention.
Figure 8:
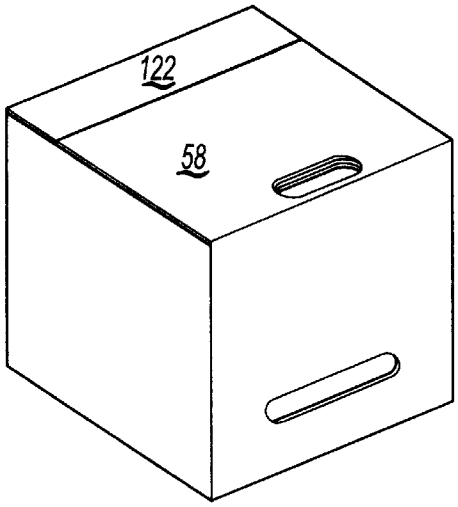
FIG. 8 is a perspective view of the assembled container using the fiberboard blank of FIG. 2.

In FIG. 1, the first and second slots 30, 102 are roughly centralized on the first and third flaps 18, 90. Referring to FIG. 2, it can be seen that the positioning of the first and second slots 30, 102 may be varied. Of course, the size of the second and fourth upper flaps 58, 122 would have to be adjusted such that the first and second projections 70, 130 could be forced into an interference fit with the first and seconds slots 30, 102, as shown in FIG. 8.

Figure 3:
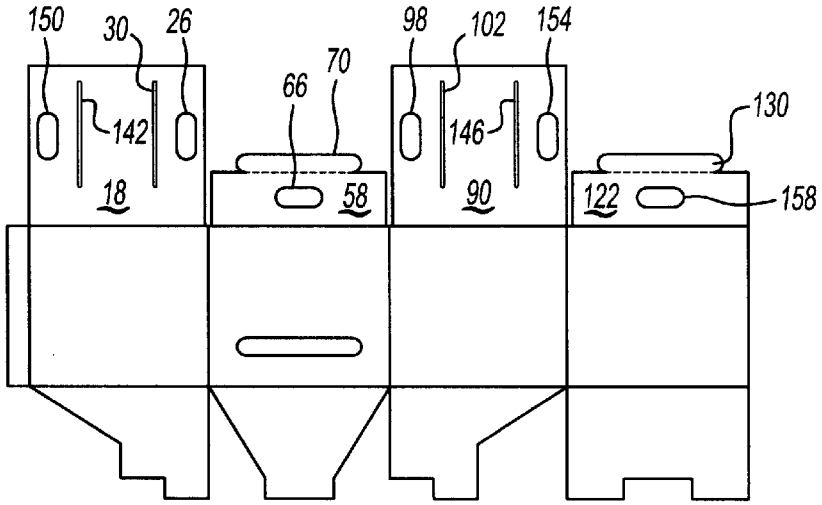
FIG. 3 is a top view of a fiberboard blank according to yet another embodiment of the present invention.
Figure 9:
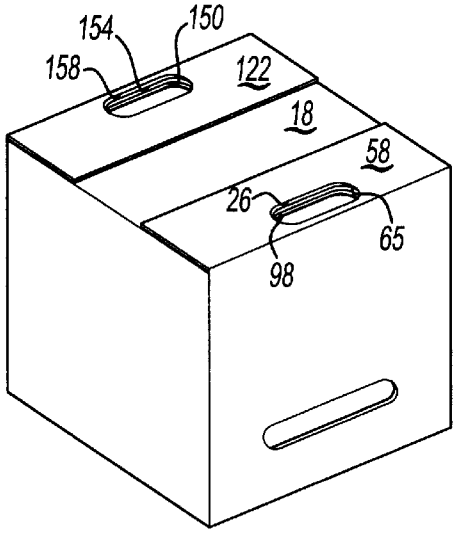
FIG. 9 is a perspective view of the assembled container using the fiberboard blank of FIG. 3.

In another embodiment shown in FIG. 3, the first and third upper flaps 18, 90 may have a third and fourth slot 142, 146. Upon assembly, the third and fourth slots 142, 146 would align with each other and the first and second slots 30, 102 would align with each other. The first projection 70 could then be forced into an interference fit with the first and second slots 30, 102, and the second projection 130 can be forced into an interference fit with the third and fourth slots 142, 146, as shown in FIG. 9. Again, the size of the second and fourth upper flaps 58, 122 must be changed to accommodate this embodiment. Note further that the first, third and fourth upper flaps 18, 90, 122 have been manufactured with a fourth, fifth, and sixth hand hole 150, 154, 158 respectively. The fourth, fifth and sixth hand holes 150, 154, 158 will align toward the opposite side of the top of the container from the first, second and third hand holes 26, 66, 98 upon assembly.

Figure 4:
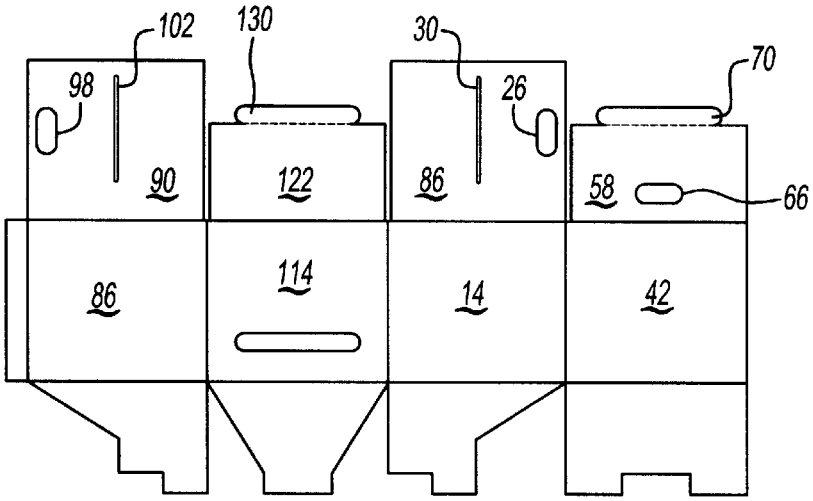
FIG. 4 is a top view of a fiberboard blank according to still another embodiment of the present invention.
Figure 10:
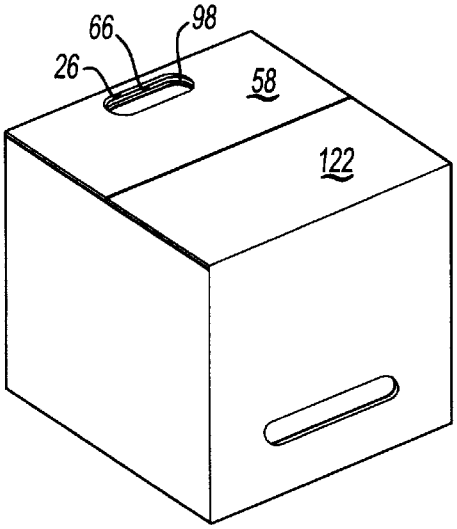
FIG. 10 is a perspective view of the assembled container using the fiberboard blank of FIG. 4.

Further, as can be seen in FIG. 4, the arrangement of the first, second, third and fourth side panels 14, 42, 86, 114 may be foldably connected in any order that allows adjacent panels to be folded at substantially right angles to one another such that the first and third panels 14, 86 oppose each other and the second and fourth panels 42, 114 oppose each other. As long as the first and third panels 14, 86 oppose each other, the first and third upper flaps 18, 90 may be cut such that the first and third hand holes 26, 98 and the first and second slots 30, 102 will align upon folding. Then the second and fourth upper flaps 58, 122 may be folded over and the first and second projections 70, 130 may be forced into an interference fit with the first and second slots 30, 102, and the second hand hole 66 aligns with the first and third hand holes 26, 98, as shown in FIG. 10.

Again referring to FIG. 1, it should be noted that the second side panel 42 includes a hole 162 that may be used for placing articles inside or taking articles out of the container once it is assembled. The hole 162 may be used to extract wire that is spooled up inside the container. Further, the hole 162 may be placed anywhere on the container.

From the discussion of the invention, it should become obvious that the container described may be created from a single blank of fiberboard and has the advantage of a strong triple layer top hand hole with large carrying capacity. Further, the container can be easily manufactured and assembled without the need for extra sealing or attaching materials beyond the fiberboard blank although extra materials may be used if desired.

The disclosed embodiments and examples are given to illustrate the present invention. However, they are not meant to limit the scope and spirit of the present invention. Therefore, the scope of the present invention should be considered by reviewing the appended claims.

What is claimed is:

1. A fiberboard blank for making a container, comprising:

a first side panel foldably connected to a first upper flap, the first upper flap having a first slot and a first hand hole;

a second side panel foldably connected to a second upper flap, the second upper flap having a second hand hole and a first projection;

a third side panel foldably connected to a third upper flap, the third upper flap having a second slot and a third hand hole;

a fourth side panel including a fourth upper flap foldably connected to the fourth side panel, the fourth flap having a second projection;

wherein the first, second, third and fourth panels are foldably connected to each other in an order that allows adjacent panels to be folded at substantially right angles to one another such that the first and third panels oppose each other and the second and fourth panels oppose each other;

and wherein the first and third upper flaps may be folded to overlap each other and align the first hand hole with the third hand hole and the first slot with the second slot;

and wherein the second upper flap may be folded over such that the second hand hole overlappingly aligns with the first and third hand holes and the first projection is received in the first and second slots;

and wherein the fourth flap may be folded over such that the second projection is received in the first and second slots.

2. A fiberboard blank according to claim 1, wherein the blank is constructed from corrugated cardboard.

3. A fiberboard blank according to claim 1, further including an attachment flap foldably connected to the first side panel;

wherein the attachment flap may be attached to the fourth side panel upon assembly of the container.

4. A fiberboard blank according to claim 1, further including a first lower flap foldably connected to the first side panel;

a second lower flap foldably connected to the second side panel;

a third lower flap foldably connected to the third side panel;

a fourth lower flap foldably connected to the fourth side panel;

wherein the first, second, third and fourth lower flaps may be connected to each other in a crash-bottom style.

5. A fiber board blank according to claim 1, further including two lower flaps foldably connected to two of the first, second, third and fourth side panels;

wherein the two lower flaps may be folded to overlap each other and be attached to each other.

6. A fiberboard blank according to claim 1, further including a fourth hand hole on said fourth upper flap;

a fifth hand hole in the first upper flap;

a sixth hand hole in the third upper flap;

wherein the fourth, fifth, and sixth hand holes align upon assembly of the container and the second projection is received in the first and second slots.

7. A fiberboard blank according to claim 1, wherein each of the first, second, third and fourth side panels are each foldably connected to two of the first, second, third and fourth panels such that the first, second, third, and fourth side panels form and unbroken chain of panels.

8. A fiberboard blank for making a container, comprising:

a first upper flap having a first slot and a first hand hole;

a second upper flap having a second hand hole and a first projection;

a third upper flap having a second slot and a third hand hole;

a fourth upper flap having a second projection and a fourth hand hole;

a fifth hand hole in the first upper flap; and a sixth hand hole in the third upper flap, wherein the first upper flap and the third upper flap overlap to align the first hand hole with the third hand hole and to align the first slot with the second slot;

and wherein the second upper flap overlaps the first upper flap and the third upper flap to align the second hand hole with the first and third hand hole and the first projection may be received in the first and second slots;

and wherein the fourth, fifth, and sixth hand holes align upon assembly of the container and the second projection is received in the first and second slots.

9. A fiberboard blank for making a container comprising:

a first side panel foldably connected to a first upper flap and a first lower flap, the first upper flap having a first slot and a first hand hole;

a second side panel foldably connected to a second upper flap and a second lower flap, the second upper flap having a second hand hole and a first projection;

a third side panel foldably connected to a third upper flap and a third lower flap, the third upper flap having a second slot and a third hand hole;

a fourth side panel foldably connected to a fourth upper flap and a fourth lower flap, the fourth upper flap having a second projection;

wherein the first, second, third and fourth panels are foldably connected to each other in an order that allows adjacent panels to be folded at substantially right angles to one another such that the first and third panels oppose each other and the second and fourth panels oppose each other;

and wherein the first and third upper flaps may be folded to overlap each other and align the first hand hole with the third hand hole and the first slot with the second slot;

and wherein the second upper flap and the fourth upper flap may be folded over such that the second hand hole aligns with the first and third hand holes and the first and second projections are received in the first and second slots;

and wherein the first, second, third and fourth lower flaps may be connected to each other in a crash-bottom style.

10. A fiberboard blank according to claim 9, further including an attachment flap foldably connected to the first side panel;

wherein the attachment flap may be attached to the fourth side panel upon assembly of the container.

11. A fiberboard blank according to claim 9, further including a fourth hand hole in the fourth upper flap;

a fifth hand hole in the first upper flap;

a sixth hand hole in the third upper flap;

wherein the fourth, fifth, and sixth hand holes align upon assembly of the container.

12. A fiberboard blank according to claim 9, wherein each of the first, second, third and fourth side panels are each foldably connected to two of the first, second, third and fourth panels such that the first, second, third, and fourth side panels form and unbroken chain of panels.

13. A fiberboard blank for making a container, comprising:

a first upper flap having a first slot and a first hand hole;

a second upper flap having a second hand hole and a first projection;

a third upper flap having a second slot and a third hand hole; and a fourth upper flap having a second projection, wherein the first upper flap and the third upper flap overlap to align the first hand hole with the third hand hole and to overlap to align the first slot with the second slot;

and wherein the second upper flap overlaps the first upper flap and the third upper flap to align the second hand hole with the first and third hand hole and the first projection may be received in the first and second slots;

and wherein the fourth upper flap overlaps the first and third upper flaps and the second projection is received in the first and second slots.

* * * * *